US006101958A

United States Patent [19]

Beckmann et al.

[11] Patent Number: 6,101,958

[45] Date of Patent: Aug. 15, 2000

[54] METHOD OF AND APPARATUS FOR THERMAL DEGRADATION OF WASTE

[75] Inventors: Ralf Beckmann, Essen; Arvid Christmann, Pulheim; Joachim Dohmann, Oberhausen; Kai Keldenich, Essen; Rolf Kümmel, Spangenberg; Frank Niermann, Mülheim/Ruhr; Wilhelm Rüben, Krefeld; Johannes Seippel, Dortmund, all of Germany

[73] Assignee: Deutsche Babcock Anlagen GmbH, Oberhausen, Germany

[21] Appl. No.: 09/026,495

[22] Filed: Feb. 19, 1998

[30] Foreign Application Priority Data

Feb. 20, 1997 [DE] Germany ..... 197 06 606

[51] Int. Cl.[7] ..... F23G 5/00; F23G 5/02; F23G 5/44; F23G 5/50; F23N 1/00

[52] U.S. Cl. ..... 110/346; 110/342; 110/234; 110/185; 110/187; 110/261; 110/347

[58] Field of Search ..... 110/252, 185, 110/187, 190, 261, 262, 260, 104 B, 292, 234, 346, 342, 263, 186, 188, 347, 229, 344

[56] References Cited

U.S. PATENT DOCUMENTS

| | | | |
|---|---|---|---|
| 1,661,031 | 2/1928 | Butcher | 110/261 |
| 3,766,866 | 10/1973 | Krumm | 110/190 |
| 3,847,094 | 11/1974 | Taeymans et al. | 110/8 R |
| 4,038,032 | 7/1977 | Brewer et al. | 23/230 A |
| 4,422,388 | 12/1983 | Raskin | 110/261 |
| 4,517,906 | 5/1985 | Lewis et al. | 110/346 |
| 4,635,572 | 1/1987 | Nickel | 110/343 |
| 4,639,209 | 1/1987 | Grethe | 431/4 |
| 4,640,203 | 2/1987 | Wolter et al. | 110/346 |
| 4,700,637 | 10/1987 | McCartney | 110/190 X |
| 4,782,773 | 11/1988 | Takaoku et al. | 110/346 |
| 4,798,532 | 1/1989 | Kimura et al. | 432/210 |
| 4,843,980 | 7/1989 | Markham et al. | 110/342 |
| 4,932,336 | 6/1990 | Srowig et al. | 110/346 |
| 4,982,672 | 1/1991 | Bell | 110/346 |
| 5,081,940 | 1/1992 | Motomura et al. . | |

(List continued on next page.)

FOREIGN PATENT DOCUMENTS

| | | |
|---|---|---|
| 997626 | 9/1976 | Canada . |
| 0 303 896 | 2/1989 | European Pat. Off. . |
| 03 03 896 A1 | 2/1989 | European Pat. Off. . |
| 0 496 325 A1 | 7/1992 | European Pat. Off. . |
| 06 67 490 A1 | 8/1995 | European Pat. Off. . |
| 0 694 737 A1 | 1/1996 | European Pat. Off. . |
| 07 18 553 A1 | 6/1996 | European Pat. Off. . |
| 2 235 335 | 1/1975 | France . |
| 0 213 980 | 3/1987 | France . |
| 0 665 407 A1 | 8/1995 | France . |
| 0 699 868 A1 | 3/1996 | France . |
| 35 37 945 A1 | 4/1987 | Germany . |
| 41 03 025 C2 | 8/1992 | Germany . |
| 44 28 159 A1 | 2/1996 | Germany . |

OTHER PUBLICATIONS

"Entwicklung einer Kamerageführlen Feuerungsregelung zur Verbesserung des Verbrennumgs–, Ausbrand–und Emissions verhaltens einer Abfallverbrennungsanlage" Busch et al., G B Kraftwerkstechnik, vol. 73, 1993, vol. 7, pp. 614–618.

Parker, Sybil P. (Editor–in–Chief), "McGraw–Hill Dictionary of Engineering", McGraw–Hill, p. 329. 1997.

*Primary Examiner*—Ira S. Lazarus
*Assistant Examiner*—Ljiljana V. Ciric
*Attorney, Agent, or Firm*—Hetbert Dubno

[57] ABSTRACT

A method of and an apparatus for the thermal degradation of refuse, garbage and other waste material in which the waste material stream is reacted with air or oxygen in a reaction chamber for pyrolysis, destructive distillation or incineration of the waste material. The released thermal energy, spatial temperature distribution or outlet gas temperature is measured and used to control a feeder which supplies particles of a supplemental fuel, itself recovered from a waste material separate from the waste material stream, to the reaction chamber.

8 Claims, 3 Drawing Sheets

U.S. PATENT DOCUMENTS 5,165,884 11/1992 Martin et al. ..... 431/7
5,317,979 6/1994 Schoppe et al. ..... 110/234
5,347,938 9/1994 Takazawa ..... 110/346
5,425,317 6/1995 Schaub et al. ..... 110/346
5,445,088 8/1995 Daugherty et al. ..... 110/346
5,551,358 9/1996 Burkhard et al. ..... 110/346
5,570,645 11/1996 Garcia-Mallol ..... 110/245
5,584,255 12/1996 Bishop et al. ..... 110/346 X
5,585,532 12/1996 Nagel ..... 588/201
5,615,626 4/1997 Floyd et al. ..... 110/346
5,681,536 10/1997 Swoboda et al. ..... 422/168
5,724,900 3/1998 Tratz ..... 110/229 X
5,762,008 6/1998 Martin et al. ..... 110/345
5,862,762 1/1999 Sekiguchi et al. ..... 110/346

METHOD OF AND APPARATUS FOR THERMAL DEGRADATION OF WASTE

FIELD OF THE INVENTION

Our present invention relates to a method of operating an apparatus for the thermal degradation of waste and to an incinerator or like reactor for pyrolytic, destructive distillation or combustion of waste materials like municipal garbage and refuse. The invention is especially directed to a process for controlling the temperature in a thermal degradation apparatus of this type.

BACKGROUND OF THE INVENTION

Waste, refuse or garbage can be fully or partly decomposed by a thermal degradation treatment utilizing a reaction chamber to which the waste material is supplied, to which air is fed for reaction with the waste material, and which is followed by a waste heat boiler which recovers heat from the gases produced.

In such apparatus, the waste material undergoes pyrolysis, destructive distillation or carbonization, or combustion.

The reaction products are generally partly gas and partly solid residues like ash, carbonized products or partly carbonized products. To achieve the greatest possible degree of reaction of the waste material, the maintenance of a reaction temperature sufficient for the reaction is important. The heat raising the temperature of the incoming waste stream from the inlet temperature to the reaction temperature and the heat required for the decomposition reaction primarily derives from the waste stream itself and as a rule the supply of additional energy is not necessary.

However, there are phases in the operation of such apparatus when the amount of heat liberated by the reaction is too small for maintaining the requisite reaction temperature. In such unfavorable operating conditions, external energy must be supplied. In the past, the supply of external energy has been accomplished by providing the apparatus with one or more burners, so called support burners, utilizing commercially available fuel. Such fuel could be solid fuels, for example coal, combustible liquids, for example fuel oil, or combustible gases, for example methane.

As a rule as well, when such burners are used, they are also supplied with the requisite oxygen, usually in the form of combustion air. The supply of air can be effected in an air excess which is desirable for decomposing the waste stream. However, support burners of this type require the use of relatively expensive fossil fuels.

The waste stream to be decomposed is highly heterogeneous. It is usually composed of combustible materials, water and uncombustible or only partly combustible materials, such that the heat value of the waste stream fluctuates greatly. It is known to use a waste fraction which has a high heat value by separating it from the waste and processing it to granules.

OBJECTS OF THE INVENTION

It is, therefore, the principal object of the present invention to provide a method of controlling the temperature in an apparatus for the thermal degradation of waste, particularly municipal waste and garbage, whereby drawbacks of earlier systems can be obviated.

It is another object of the invention to provide an improved method of operating a thermal waste disposal system which ensures more efficient operation thereof, especially in the case of variations in the heat value of the waste stream.

It is also an object of the invention to provide an improved apparatus or plant for the thermal degradation of waste materials which will allow better control of the reaction temperature.

SUMMARY OF THE INVENTION

These objects and others which will become more readily apparent hereinafter are attained, in accordance with the invention by the use of an additive fuel which is recovered from waste material as a dust, powder or granular product, the substitute fuel being supplied to the reaction chamber separately from the waste stream and in response to the released thermal power in the reaction chamber and/or the spatial temperature distribution and/or the temperature at the outlet of the reaction chamber.

According to the invention the ignition of the supplemental fuel must be ensured. This can be done by a separate ignition apparatus or by conditions in the reaction chamber which will sustain autoignition of the supplemental fuel.

In apparatus terms, the method is carried out by introducing the supplemental or additive fuel through one or more lances spaced from the feeder or inlet for the waste material, the lances opening into the reaction chamber and being connected to a feeder which itself is controlled by signals representing the released thermal power in the reaction chamber or the outlet gas temperature thereof.

The combustion chamber can be equipped with a grate and, in a preferred embodiment, the supplemental fuel is supplied to the reaction chamber by a muffle having a twist head into which air is admitted tangentially. The mouth of the muffle is provided with bores for admitting a curtain of air into the chamber and protecting the muffle against thermal degradation.

More particularly, the method of the invention can comprise the steps of:

(a) thermally reacting waste material to be degraded with air in a reaction chamber to at least partly decompose the waste material and produce a gas;

(b) a waste-heat boiler downstream of the reaction chamber and recovering heat from the gas;

(c) recovering from a waste material a subdivided additive fuel and introducing the additive fuel into the reaction chamber as a supplemental fuel separately from the waste material to be degraded;

(d) measuring at least one parameter selected from a released thermal energy in the reaction chamber, the spatial temperature distribution of the reaction chamber obtained by means of a thermooptical or a thermographic system (e.g. an infrared camera), and a temperature at an outlet from the reaction chamber; and (e) controlling feed of the subdivided additive fuel into the reaction chamber in response to the parameter.

The apparatus can comprise:

means for forming a reaction chamber for thermally reacting waste material to be degraded with air to at least partly decompose the waste material and produce a gas, the reaction chamber having an inlet for the waste material to be degraded, and an outlet for the gas;

a waste heat boiler connected to the outlet for recovering heat from the gas;

means for measuring at least one parameter selected from released thermal energy in the reaction chamber, the spatial temperature distribution in the reaction chamber, and a temperature at the outlet; and means connected with the means for measuring for controlling feed of the subdivided additive fuel into the reaction chamber in response to the parameter.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
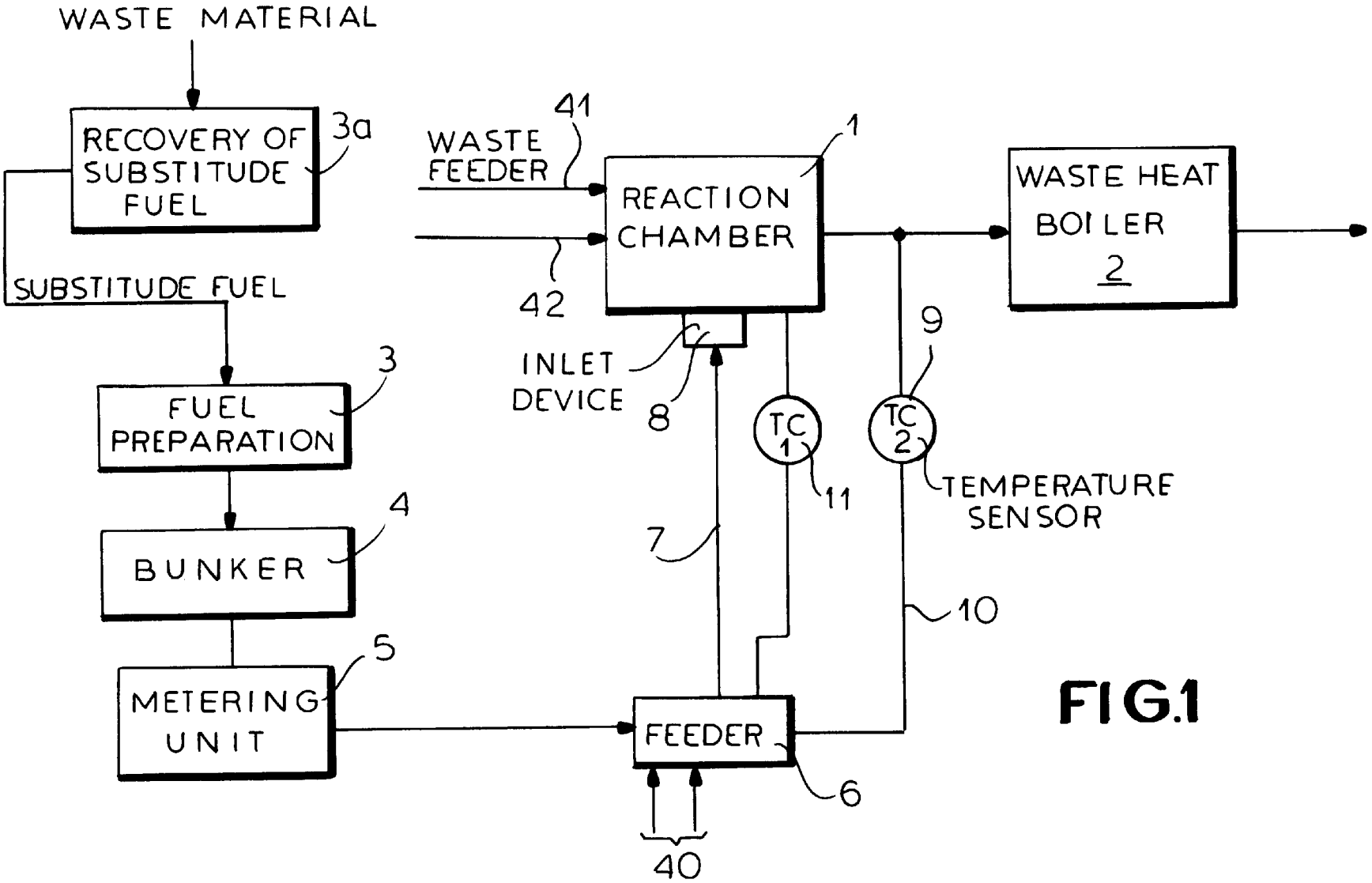
FIG. 1 is a block diagram of a process for thermal waste treatment in accordance with the invention.

The apparatus of the invention is intended for the thermal treatment of waste and, more particularly, the thermal decomposition (especially incineration) of refuse and like waste products in which the waste product is reacted with combustion air.

The reaction takes place in a reaction chamber 1. The refuse or waste can be subjected in this reactor to a pyrolysis, to carbonization or destructive distillation, or to combustion, or to a combination of the three. The reaction gas is cooled in a waste heat boiler 2 and then subjected to cleaning treatments if necessary and utilized as a source of any recoverable components, for residual heat value or for other utility purposes.

In the case in which the heat which is liberated by the reaction of the waste or refuse with the combustion air is not sufficient to maintain the reaction in the reaction chamber 1, the heat deficiency is made up by a supporting combustion. The fuel for supporting combustion can be introduced in the form of a supplemental fuel which can be recovered at 3*a* from waste or refuse and is introduced in dust, powder or granular form.

The supplemental fuel, depending upon its form, is subjected to a preparative treatment at 3 to establish the desired characteristics such as, for example, the particle size of the granules or such other mechanical or processing characteristics which may be required. This fuel preparation stage 3 may involve, therefore, comminution, or agglomeration (e.g. pelletizing) with the prepared supplemental fuel being stored in a bunker or bin 4.

The bunker 4 is provided with a metering unit 5 which withdraws the supplemental fuel from the bunker and supplies the substitute fuel to a feeder 6. The metering unit or discharge unit 5 can be a worm, a cell-wheel gate for the bunker or the like. The feeder 6 can be a pneumatic feeder which introduces the fuel into the reaction chamber 1, entrained in combustion air. The feeder 1 fulfills the function of maintaining the mass flow or enthalpy flow of the substitute fuel to the reaction chamber.

The feeder 6 is connected by a feed line 7 to an inlet device which introduces the supplemental fuel into the reaction chamber separately from the introduction of the waste or refuse therein. The inlet device, may, for example be a plurality of inlet orifices through which the supplemental fuel is pneumatically introduced into the reaction chamber.

The quantity of the supplemental fuel which is introduced is controlled in response to the thermal energy released in the reaction chamber. For this purpose a temperature measuring sensor 9 is provided at the gas outlet of the reaction chamber 1. The temperature sensor 9 is connected to the feeder 6 by a control line 10 and supplies a set point in the form of information for establishing the requisite mass flow.

A further measuring sensoring 11 can be a thermometer or an image forming thermooptical or thermographical system for monitoring the reaction conditions in reaction chamber 1. The measuring results are provided as a control input to the feeder 6. The actual value signal of the mass flow or the enthalpy flow can be compared with the set-point information in the feeder for adjustment of the throughput thereof.

The diagram of the process has not shown in any detail the instrumentation which controls the supply of air to the feeder 6 or which provides inputs as to the characteristics of the supplemental fuel stream to the feeder 6 These however, are represented at 40 in FIG. 1. The control set point for the temperature in the reaction chamber, which are compared with the measurements at 9 and 11, can also be represented by the inputs 40.

To the extent that the device 8 is not equipped with its own ignition unit for the supplemental fuel, the substitute fuel is only introduced by the control system for the feeder 6 when the conditions exist in the reaction chamber 1 for self-ignition of the supplemental fuel.

If combustion of the waste or refuse occurs in the reaction chamber 1, the latter can be formed as a fluidized bed reactor, a rotary tube furnace or kiln or as a firing grate.

Figure 2:
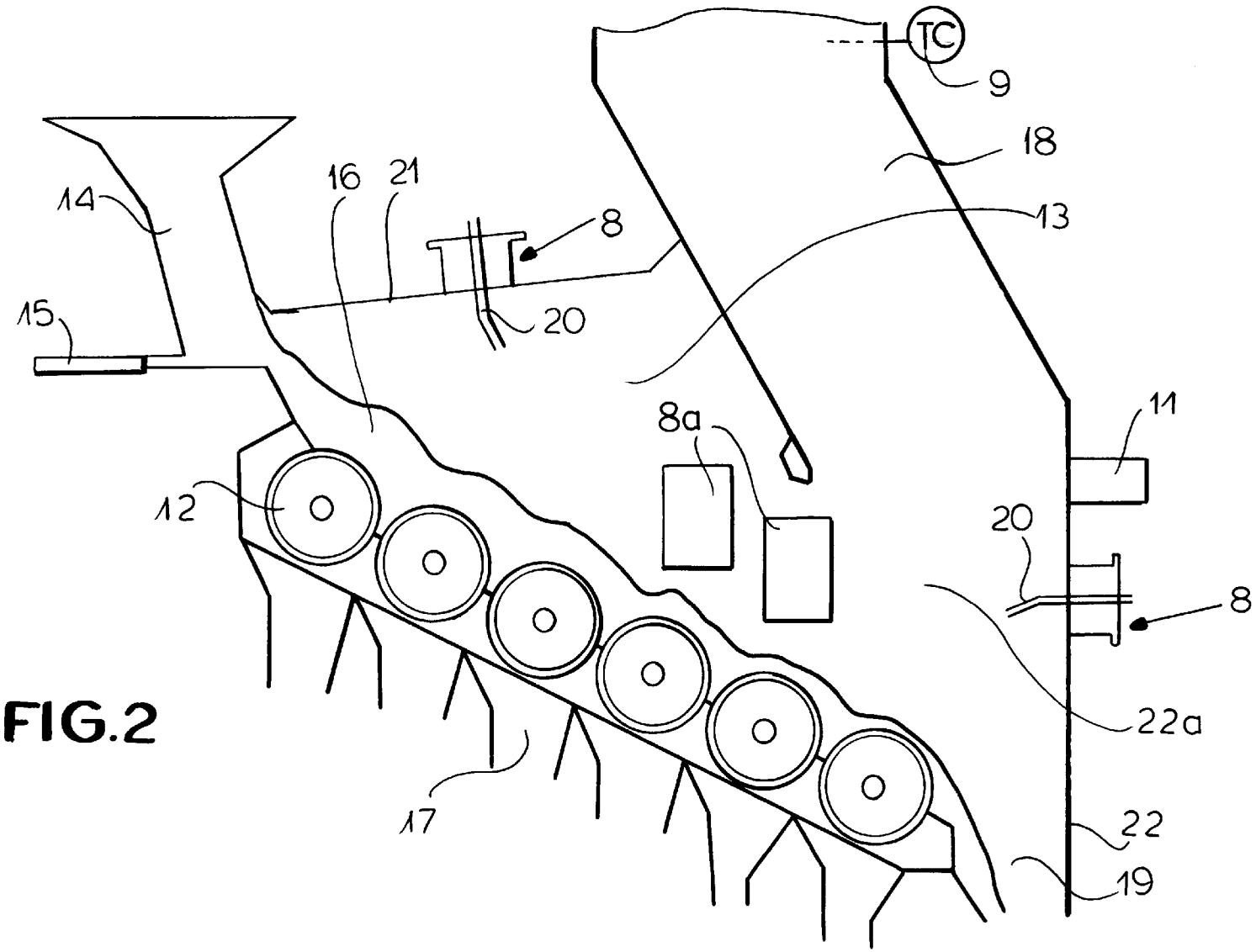
FIG. 2 is a diagrammatic section through a portion of a thermal treatment apparatus.

FIG. 2 shows a furnace of the travelling grate type in which the grate comprises grate rollers 12 over which a bed of the refuse passes and above which a combustion chamber 13 is formed.

The refuse to be incinerated reaches the combustion chamber 13 via the reaction space of a thermolytic decomposition stage, via the supply funnel 14 and a sliding feeder 15.

The refuse forms a bed 16 on the roller grate which displaces the material during combustion through the combustion chamber 13.

A part of the combustion air requirement for the decomposition reaction is supplied by the lower blowing box with its channels 17 beneath the combustion chamber 13. The balance of the combustion air is fed to the combustion chamber 13 or into an afterburner stage 18 following the combustion chamber 13 as secondary air. The afterburner 18 is connected to the waste heat boiler 2 not seen in FIG. 2.

After the decomposition, residual solids are discharged at the outlet 19 and are there removed from the combustion chamber 13.

The inlet device 8 can comprise a lance 20 by means of which the supplemental fuel can be pneumatically introduced into the combustion chamber 13.

In the drawing two such lances have been shown schematically. One lance 20 can be provided in the roof 21 of the combustion chamber 13 while another can be provided in an end wall 22 at which the residues are discharged. The lances 20 have been shown only schematically in FIG. 2.

When the lance is provided in the roof of the incinerator, the energy from the supplemental fuel is fed to the upstream end of the bed 16 of refuse on the grate.

It is also possible to provide inlet units 8*a* with similar lances which open into the rear wall 22*a* of the incinerator, close to the leading end of the bed 16 on the travelling grate.

The lances 20 can, to increase their useful lives, be composed of refractory material or can be surrounded by refractory material and/or be provided in a double wall or jacketed configuration so that cooling water can be circulated therethrough. So-called shell tubes can be provided as inlet units with or without air curtains to protect them. The air curtains can completely or partly replace the secondary air.

To reduce the velocity of the substitute fuel as it emerges from the lances 20, the mouths of the lances can be outwardly divergent, i.e. have the configuration of a diffuser.

The mouths of the lances 20 can be flush with the roof, end wall or front or rear wall or can project into the combustion chamber 13 as has been shown in FIG. 2. The outlet velocity vector of the supplemental fuel can be inclined to normals to the wall or roof so that the mouth of each lance can lie at an angle to a normal to the wall or roof through which the lance extends. This is advantageous when the location at which the lance must be installed is offset from the location at which delivery of the additional energy via the substitute fuel is desired. The angled orientation of the lances optimizes the combustion process in the combustion chamber.

The information as to the temperature and other characteristics of the reaction in the combustion chamber 13 can be obtained by the thermographical system 11 or a temperature sensor 9 from the afterburning zone 18 and supplied to the feeder 6.

Figure 3:
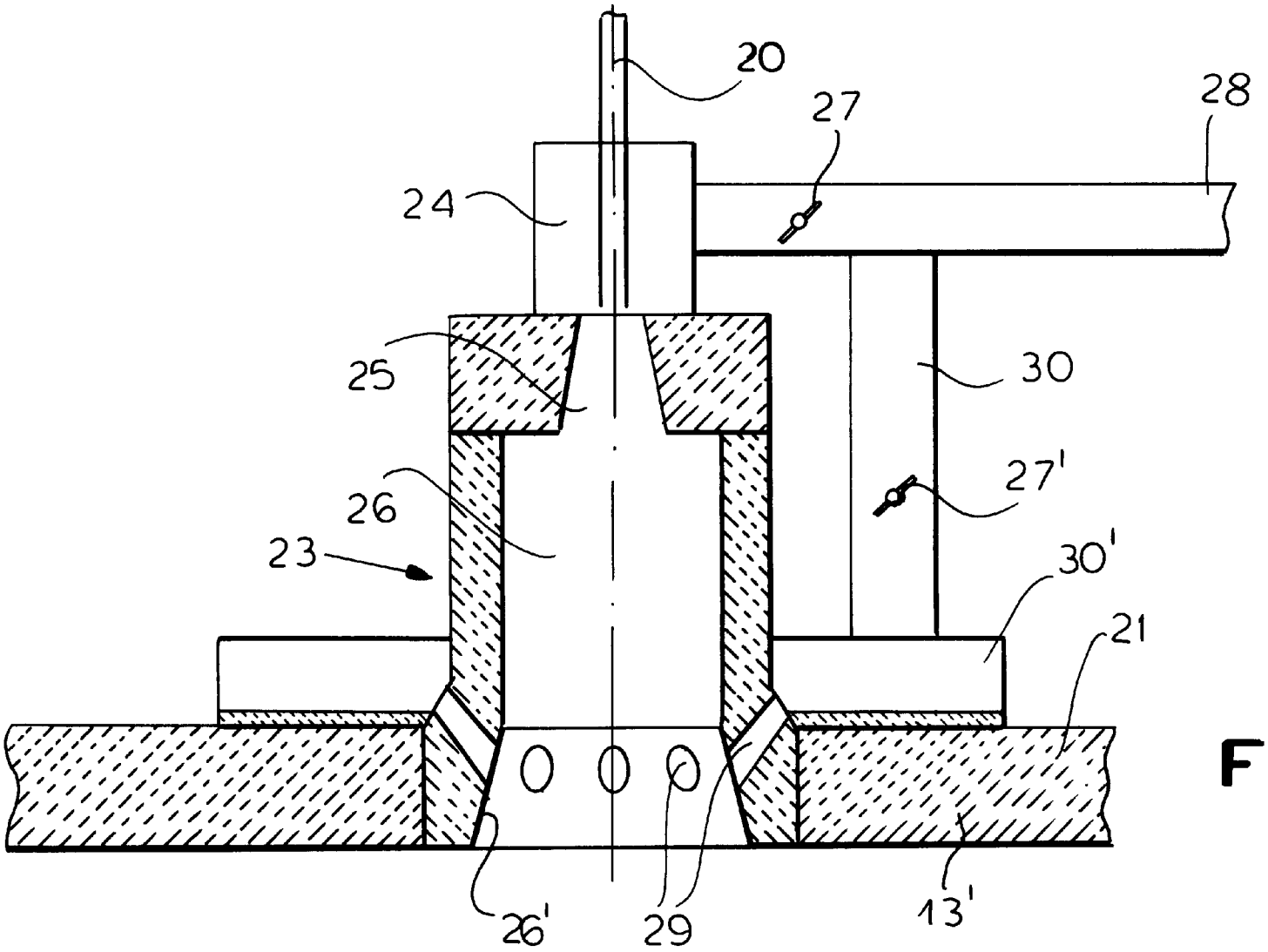
FIG. 3 is a section through a muffle for the introduction of fuel.

As has been shown in FIG. 3, an inlet device 8,8*a* for the granular supplemental fuel can also be constructed, as a muffle 23. The muffle 23 has a spin head 24 in which the lance 20 opens. The spin head 24 is connected via a diffuser passage 25 with a mixing chamber 26 axially aligned with the lance, the spin head 24 and the diffuser 25.

The mixing chamber 26 is mixed of cylindrical configuration and composed of a refractory material. Towards its outlet end it has a diffuser-like divergence. The inner wall of the combustion chamber 13 has been represented at 13' in FIG. 3.

The spin head 24 admits air tangentially from an air conduit 28 as controlled by a shut-off or control flap 27. The supplemental fuel can be fed by, for example, a worm conveyor to the spin head 24 if desired and the fuel can be entrained in the tangential vortex of air into the diffuser 25 which turbulently distributes the fuel and air throughout the mixing chamber 26. Alternatively, the fuel particles can be blown into the spin head via the lance 20 as has been indicated in FIG. 3. As a consequence, there is good mixing of the substitute fuel and air with a reduction of the velocity in the mixing chamber 26. The supplemental fuel-air mixture in the mixing chamber 26 can self-ignite from radiant heat from the combustion chamber 13. This combusting mixture then enters the combustion chamber via diffuser shaped outlet 26' which can be equipped with radial-axial bores 29 supplied with air from a plenum 30' connected by the air duct 30 to the duct 28. A control or blocking flap 27' regulates the air fed through the inclined bores 29. The air delivered by these bores form a cooling air curtain at the end of the muffle and thus protects the muffle 23 from overheating.

In FIG. 1, the feeder for the refuse has been represented diagrammatically at 41 and the combustion air inlet at 42.

The supplemental fuel which is fed to the fuel preparation unit 3 may be recovered from waste materials and exhibits a high calorific value (e.g. wood scraps or plastic).

We claim:

1. A method of operating an apparatus for thermal degradation of a waste material, comprising the steps of:

(a) thermally reacting a first waste material to be degraded with air in a reaction chamber to at least partly decompose said waste material and produce a gas;

(b) passing the gas produced in step (a) through a waste-heat boiler downstream of said reaction chamber and recovering heat from said gas;

(c) recovering from a second waste material an additive fuel which is separate from the waste material reacted in step (a) and which is in dust, powder or granular form and introducing said additive fuel into said reaction chamber as a supplemental fuel separately from said first waste material to be degraded;

(d) measuring at least one parameter selected from a released thermal energy in said reaction chamber, the spatial temperature distribution in the reaction chamber, and a temperature at an outlet from said reaction chamber;

(e) controlling feed of said subdivided additive fuel into said reaction chamber in response to said parameter: and (f) admitting said additive fuel into said reaction chamber only when conditions exist in said reaction chamber enabling autoignition of the substitute fuel.

2. The method defined in claim 1 wherein said additive fuel is recovered in the form of a dust or powder.

3. The method defined in claim 1 wherein said additive fuel is recovered in the form of granules.

4. An apparatus for thermal degradation of a waste material, comprising:

means for forming a reaction chamber for thermally reacting a first waste material to be degraded with air to at least partly decompose said waste material and produce a gas, said reaction chamber having an inlet for said first waste material to be degraded, and an outlet for said gas;

a waste heat boiler connected to said outlet for recovering heat from said gas;

means for providing, from a second waste material separate from the waste material reacted in said chamber, an additive fuel in dust powder or granular form and introducing said additive fuel into said reaction chamber as a supplemental fuel separately from said first waste material to be degraded;

means for measuring at least one parameter selected from a thermal energy released in said reaction cheer, the spatial temperature distribution in the reaction chamber, and a temperature at said outlet;

means for controlling feed of said additive fuel into said reaction chamber in response to said parameter, said feed control means being connected with said measuring means; and means for admitting said additive fuel into said reaction chamber only when conditions exist in said reaction chamber enabling autoignition of the substitute fuel.

5. The apparatus defined in claim 4 wherein said means for introducing said additive fuel includes at least one lance opening into said reaction chamber through a wall thereof at a location spaced from said inlet.

6. The apparatus defined in claim 5 wherein said lance has a discharge end at an angle to a normal to said wall.

7. The apparatus defined in claim 4 wherein said reaction chamber is an incinerator chamber provided with a grate for a bed of said waste material to be degraded.

8. The apparatus defined in claim 4 wherein said means for introducing said additive fuel includes at least one muffle on a wall of said reaction chamber having a mouth opening into said chamber, a rotary head coaxial with and opening into said muffle at an end of said muffle opposite said mouth, air being supplied tangentially to said head, means for supplying said additive fuel to said head, a plurality of bores opening at said mouth, and means for supplying air to said bores, whereby air emerging from said bores forms a curtain protecting said muffle.

* * * * *